United States Patent [19]

Horwath

[11] 4,281,827

[45] Aug. 4, 1981

[54] MITER BOXES

[76] Inventor: Gary W. Horwath, 9900 Georgia Ave., Apt. #702, Silver Spring, Md. 20902

[21] Appl. No.: 88,912

[22] Filed: Oct. 29, 1979

[51] Int. Cl.[3] ..... B25B 1/02; B25B 5/10

[52] U.S. Cl. ..... 269/189; 83/466; 83/581; 83/766; 269/295

[58] Field of Search ..... 83/762, 761, 766, 466, 83/581; 269/295, 189, 56, 321 N

[56] References Cited

U.S. PATENT DOCUMENTS

| | | | |
|---|---|---|---|
| 363,119 | 5/1887 | Criswell | 83/466 X |
| 511,935 | 1/1894 | Criswell | 83/466 X |
| 688,879 | 12/1901 | Otis | 83/766 |
| 889,026 | 5/1908 | Magrath | 83/766 |
| 976,296 | 11/1910 | Robbins | 83/766 X |
| 2,708,466 | 5/1955 | Stoll | 83/466 X |
| 2,746,125 | 5/1956 | Cuny | 83/466 |

*Primary Examiner*—Frank T. Yost
*Attorney, Agent, or Firm*—Gary W. Horwath

[57] ABSTRACT

An improved miter box allows crown molding to be cut in the same orientation in which it will be installed to assure a perfect mitered joint. The miter box holds a longitudinal workpiece so that it can be cut by a cutting apparatus at a first angle measured in a plane parallel to the longitudinal axis of the workpiece and at a second angle measured in a plane perpendicular to the longitudinal axis of the workpiece. The miter box has a base, a backboard mounted perpendicularly on one edge of the base, a cutting apparatus guide for guiding the cutting apparatus to cut the workpiece at the first angle, a first wedge apparatus mounted on the backboard having a lower surface at the second angle to the backboard, and a second wedge apparatus mounted on the base having an upper surface at the second angle to the backboard. The second wedge apparatus is movable toward and away from the backboard so that the workpiece may be positioned between the first and second wedge apparatus and is engageable to the backboard to clamp the workpiece between the first and second wedge apparatus when the workpiece is being cut.

8 Claims, 2 Drawing Figures

MITER BOXES

BACKGROUND OF THE INVENTION

This invention relates to improvements in miter boxes which are particularly well suited for cutting crown or cove molding.

In the cutting and installation of molding, mitered joints provide the most attractive and perfect appearing joints. In making an inside mitered joint for two walls meeting at a 90° angle, for example, the two pieces of molding meeting at the joint must be cut at an angle so that the exposed portion of the molding is shorter than that directly against the walls themselves. This is a standard concern which for non-crown molding applications can be easily achieved by a standard miter box cut of 45°. When crown molding is to be cut, an extra complication arises. Since crown molding meets not only the two walls, but also the ceiling, the unexposed portion of the molding has two perpendicular faces (assuming the ceiling is perpendicular to the walls). Use ofa standard miter box to cut a 45° angle with respect to either one of the two flat sides of the molding will give a 90° angle with respect to the other side. However, the cut should be at a non-right angle to both such sides.

Therefore in cutting crown molding, several steps have been necessary to cut outside and inside corners. Inside corners are normally made by returning one end of a first length of the molding flush to the perpendicular wall. The other piece of molding which forms the inside corner is cut diagonally so that the bottom is the longest part of the molding. This diagonal cut is coped to conform to the shape of the first piece of the molding. The coping is necessarily a tedious, cumbersome, expensive and, all too often, imperfect process. Even though the expense of additional labor must be committed to making such a joint, the result is not a true mitered joint and unless the laborer is highly skilled, the finished appearance will be less than satisfactory.

An alternative method of cutting crown molding has been to set nails at specific points in the base of the miter box. The molding then is braced against the back of the miter box so that the nails prevent the bottom from slipping forward. When a cut is made at the normal 45° angle for the mitered joint, the molding is not laying flat on the base of the miter box, but rather at some angle to the miter box base. This makeshift jig is in many ways unsatisfactory to provide a mitered joint for inside and outside corners of crown molding. The size of the molding susceptible to use in such a jig is limited by the size of the back of the miter box. Further, it is difficult to hold the molding in place in this makeshift jig when using a hand saw type miter box. Since the jig does not exactly duplicate the orientation of the molding as installed, the carpenter using such a jig is forced to go through extra calculations to ascertain the proper cut.

The same drawbacks prevent the miter boxes disclosed in U.S. Pat. No. 3,590,801, No. 3,397,722 and No. 1,286,417 from being very practical. Likewise, the miter box revealed in U.S. Pat. No. 1,718,791 could not be used to cut crown or cove molding in the same orientation as installed.

Accordingly, the present invention provides a device for achieving a cut in crown or other molding which is suitable for making perfect mitered corners, without requiring undue calculations or other complicated procedures.

SUMMARY OF THE INVENTION

The present invention relates to a miter box for holding a longitudinal workpiece to be cut by a saw or other cutting device at a first angle measured in a plane parallel to the longitudinal axis of the workpiece and simultaneously at a second angle measured in a plane perpendicular to the longitudinal axis of the workpiece. Such a miter box includes a base, a backboard mounted perpendicularly on one edge of the back, a conventional saw guide for guiding the saw to cut the workpiece at the first angle, a first wedge mounted on the backboard having a lower surface at the second angle to the backboard, and a second wedge mounted on the base having an upper surface at the second angle to the backboard, the second wedge being movable toward and away from the backboard so that the workpiece may be positioned between the first and second wedges and being engageable to the backboard to clamp the workpiece between the first and second wedges when the workpiece is cut. A preferred embodiment of the improved miter box has adjustable first and second wedges so that they may be adjusted to the pitch of the ceiling to allow a user to cut crown molding for ceilings not perpendicular to the walls.

BRIEF DESCRIPTION OF THE DRAWINGS

A more thorough understanding of the invention will be obtained from the following detailed description and accompanying disclosures wherein.

DETAILED DESCRIPTION OF THE INVENTION

Figure 1:
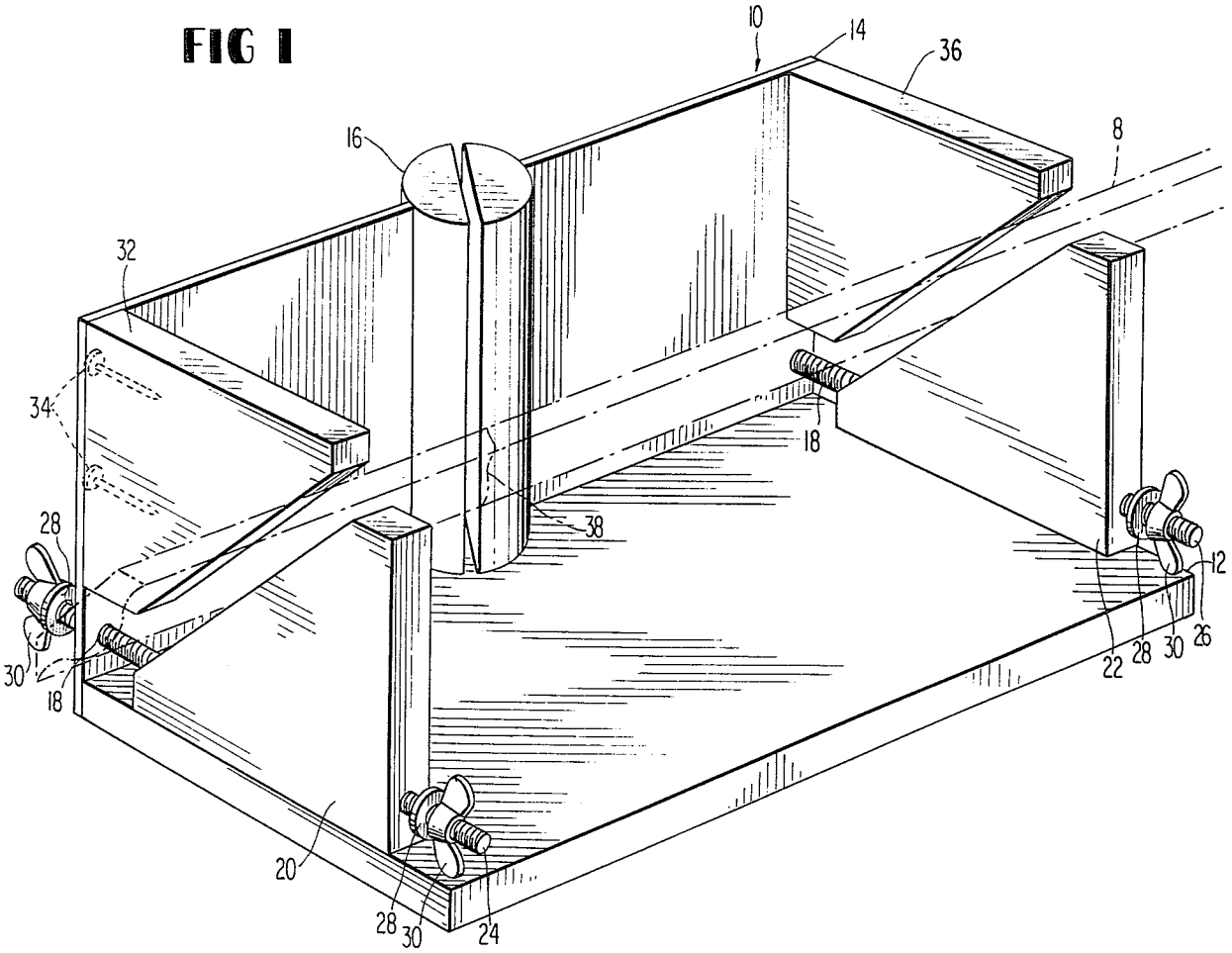
FIG. 1 shows a perspective view of a miter box according to the present invention, with its wedges and a workpiece shown in phantom.

As shown in FIG. 1, miter box 10 resembles a conventional miter box by having a base 12 and a backboard 14. A conventional saw guide 16 is provided for cutting molding 8 as in prior art miter boxes. Since the saw guide is not an essential part of the present invention, it is illustrated in FIG. 1 as a schematic representation, for the sake of clarity. It is understood that any conventional cutting guide which does not interfere with the remainder of the invention could be used. Cutting guide 16 is rotatable so that workpiece 8 can be cut at any desired angle by rotating saw guide 16 to the proper orientation.

Backboard 14 is provided with holes 18. Backboard 14 further has top wedges 32 and 36 securely mounted on it. If wedges 32 and 36 are made of wood, the mounting may be by nails 34. It is understood that wedges 32 and 36 may be made of any suitable material and mounted on backboard 14 in any suitably secure manner.

Lower wedges 20 and 22 are provided having holes 32 therethrough. Passing through holes 23 and colinear holes 18 are threaded rods 24 and 26. On either end of each of these threaded rods is a washer 28 and wing nut 30. Lower wedges 20 and 22 are free to move toward and away from backboard 14, limited only by the stops represented by the positions of the respective wing nuts.

As shown in FIG. 1, the angled faces of the top and bottom wedges are disposed at 45° corresponding to the appropriate angle for symmetrical crown molding to be applied to ceilings perpendicular to the walls. It is understood that wedges having different angles can be used for achieving the proper cuts in crown molding for application to differently pitched ceilings. When it is desired to cut a piece of crown molding, such as workpiece 8, it is inserted between the angled surfaces of the top and bottom wedges, parallel with the intersection of the base and backboard, and the wing nuts are tightened to clamp the workpiece 8 between the top and bottom wedges.

As shown in FIG. 1, a crown molding such as workpiece 8 is in the same orientation it will eventually have when installed. Thus, for a right angle joint, setting saw guide 16 at a 45° cut will yield a perfect cut 38 for making a perfect miter joint. No additional coping is needed and much time, effort and cost is saved.

Figure 2:
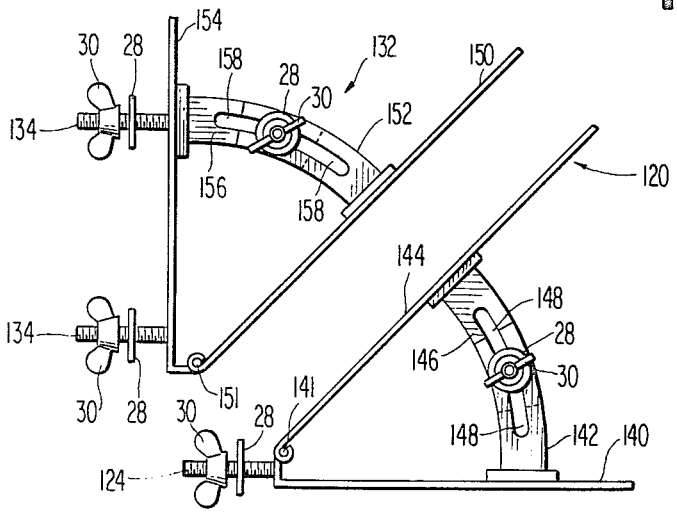
FIG. 2 shows a side view of an alternate embodiment for the wedges.

As shown in FIG. 2, top and bottom wedges 132 and 120 can be adjustable. Thus for bottom wedge 120, a first surface 140 can be provided of a flat metal, or other suitable material, Hingedly mounted at hinge 141 is second surface 144. First plate 142 extends from first surface 140 towards second surface 144 and has an arcuate slot 148 therein. Second plate 146 extends from second surface 144 toward first surface 140 and has an arcuate slot 148 therein. Both arcs of slots 148 have a radius substantially equal to the distance between the slots and hinge 141. Plates 142 and 146 may be secured together by a threaded bolt 124 and washer 28 and wing nut 30. Lower wedge 120 may be secured to backboard 14 by threaded shaft 124 as in FIG. 1. Alternatively, the backboard may be omitted and lower wedge 120 may be mounted on the base or to the lower portion of the upper wedge, as will be apparent to those skilled in the art.

A similar arrangement may be provided for the upper wedge having a vertical surface 154 for mounting onto the backboard 14 through two additional holes by threaded rods 134 and associated wing nut 30 and washer 28. Alternatively vertical surface 154 may be a standard mounted directly on base 12, hingedly attached at 151 to vertical surface 154 is lower surface 150. First plate 156 extends from vertical surface 154 toward lower surface 150 and has an arcuate slot 158 therein. Second plate 152 extends from the lower surface 150 toward vertical surface 154 and has arcuate slot 158 therein. Slots 158 are overlapping and have a radius of curvature equal to the distance between the slots and hinge 151. Plates 152 and 156 may be secured together as before.

In operation, upper wedge 132 may be secured to the backboard 14 and the angle between surfaces 150 and 154 may be adjusted to equal the angle between the exposed face of the molding as it will be installed and the vertical wall. Lower wedge 120 may be loosely mounted via threaded rod 124 onto backboard 14. The angle between first surface 140 and second surface 144 may be adjusted to equal 90° less the angle of the upper wedge. Then the workpiece may be positioned between surfaces 144 and 150 and lower wedge 120 may be drawn up to the backboard 14 by tightening wing nut 30 on threaded rod 124. The cut may then be made in conventional fashion and the resulting angle will be proper to make a perfect mitered joint in the crown molding.

Various other modifications may be made to this invention and yet fall within the scope thereof. All such variations and modifications should be construed as falling within the scope of the following claims and their equivalents.

What is claimed is:

1. A miter box for holding a longitudinal workpiece to be cut by a cutting means at a first angle measured in a plane parallel to the longitudinal axis of said workpiece and at a second angle measured in a plane perpendicular to said longitudinal axis of said workpiece comprising a base, a backboard mounted perpendicularly on one edge of said base, a cutting means guide for guiding said cutting means to cut said workpiece at said first angle, a first wedge means mounted on said backboard having a lower surface at said second angle to said backboard, a second wedge means mounted on said base and having an upper surface at said second angle to said backboard, said second wedge means being moveable toward and away from said backboard so that said workpiece may be positioned between said first and second wedge means and being engageable to said backboard to clamp said workpiece between said first and second wedge means when said workpiece is cut.

2. A miter box as claimed in claim 1, wherein said second wedge means has a hole therethrough perpendicular to said backboard, and said backboard has a hole therethrough, further comprising a threaded rod passing through said hole in said second wedge means and said hole in said backboard, and threaded nut means on said threaded rod for engaging said second wedge means to said backboard to clamp said workpiece between said first and second wedge means.

3. A miter box as claimed in claim 2, wherein said first wedge means is adjustable to vary said second angle and wherein said second wedge means is adjustable to vary said second angle in correspondence to the variation in said second angle to said first wedge means.

4. A miter box for holding a longitudinal workpiece to be cut by a cutting means at a first angle measured in a plane parallel to the longitudinal axis of said workpiece and at a second angle measured in a plane perpendicular to said longitudinal axis of said workpiece comprising a base, a cutting means guide mounted on said base for guiding said cutting means to cut said workpiece at said first angle, a first clamping means mounted on said base having a lower surface at said second angle to said base, and a second clamping means mounted on said base and having an upper surface at said second angle to said base, said second clamping means being moveable between toward and away positions from said first clamping means so that said workpiece may be positioned between said first and second clamping means and being engageable in said toward position to clamp said workpiece between said first and second clamping means.

5. A miter box as claimed in claim 4, wherein said clamping means are adjustable to vary said second angle.

6. A miter box as claimed in claim 5, wherein said clamping means comprises a first wedge means mounted on said base having a standard perpendicular to said base and a lower surface hinged to said standard, a first plate extending from said standard toward said hinged lower surface having an arcuate slot having an arc of radius equal to the distance between said slot and said hinge, a second plate extending from said lower surface toward said standard having an arcuate slot having an arc of radius equal to the distance between said slot and said hinge of said first wedge means, so that said slots of said first and second plates substantially overlap, a bolt passing through said slots and a nut means on said bolt for tightening said first and second plate together, whereby said hinged lower surface may be secured to said second angle to said standard, a second wedge means mounted on said base and having a first surface parallel to said base, a second surface hinged to said first surface, a first plate extending from said first surface toward said second surface having an arcuate slot having an arc of radius equal to the distance between said slot and said hinge of said second wedge means, a second plate extending from said second surface toward said first surface having an arcuate slot having an arc of radius equal to the distance between said slot and said hinge, so that said slots of said first and second plates substantially overlap, a bolt passing through said slots and a nut means on said bolt for tightening said first and second plates together, whereby said hinged second surface may be secured at 90 degrees minus said second angle to said first surface, so that said workpiece may be clamped between said lower surface of said first wedge means and said second surface of said second wedge means when said workpiece is cut.

7. A miter box for holding a longitudinal workpiece to be cut by a cutting means at a first non-right angle measured in a plane parallel to the longitudinal axis of said workpiece and at a second non-right angle measured in a plane perpendicular to said longitudinal axis of said workpiece comprising a base, a backboard mounted perpendicularly on one edge of said base, a cutting means guide for guiding said cutting means to cut said workpiece at said first angle, a first wedge means mounted on said backboard having a lower surface at said second angle to said backboard, a second wedge means mounted on said base and having an upper surface at said second angle to said backboard, said second wedge means being moveable toward and away from said backboard so that said workpiece may be positioned between said first and second wedge means and being engageable to said backboard to clamp said workpiece between said first and second wedge means when said workpiece is cut.

8. A miter box for holding a longitudinal workpiece to be cut by a cutting means at a first non-right angle measured in a plane parallel to the longitudinal axis of said workpiece and at a second non-right angle measured in plane perpendicular to said longitudinal axis of said workpiece comprising a base, a cutting means guide mounted on said base for guiding said cutting means to cut said workpiece at said first angle, a first wedge means mounted on said base having a standard perpendicular to said base and a lower surface hinged to said standard, a first plate extending from said standard toward said hinged lower surface having an arcuate slot having an arc of radius equal to the distance between said slot and said hinge, a second plate extending from said lower surface toward said standard having an arcuate slot having an arc of radius equal to the distance between said slot and said hinge of said first wedge means, so that said slots of said first and second plates substantially overlap, a bolt passing through said slot and a nut means on said bolt for tightening said first and second plate together, whereby said hinged lower surface may be secured at said second angle to said standard, a second wedge means mounted on said base and having a first surface parallel to said base, a second surface hinged to said first surface, a first plate extending from said first surface toward said second surface having an arcuate slot having an arc of radius equal to the distance between said slot and said hinge of said second wedge means, a second plate extending from said second surface toward said first surface having an arcuate slot having an arc of radius equal to the distance between said slot and said hinge, so that said slots of said first and second plates substantially overlap, a bolt passing through said slots and a nut means on said bolt for tightening said first and second plates together, whereby said hinged second surface may be secured at 90 degrees minus said second angle to said first surface, so that said workpiece may be clamped between said lower surface of said first wedge means and said second surface of said second wedge means when said workpiece is cut.

* * * * *